US010821448B2

(12) United States Patent
Kuopanportti et al.

(10) Patent No.: US 10,821,448 B2
(45) Date of Patent: Nov. 3, 2020

(54) APPARATUS AND METHOD FOR COMMINUTING OF MATERIAL

(71) Applicant: TUTKIMUSPALVELUT KUOPANPORTTI KY, Oulu (FI)

(72) Inventors: Hannu Kuopanportti, Oulu (FI); Ilkka Hynynen, Oulu (FI)

(73) Assignee: TUTKIMUSPALVELUT KUOPANPORTTI KY, Oulu (FI)

( * ) Notice: Subject to any disclaimer, the term of this patent is extended or adjusted under 35 U.S.C. 154(b) by 0 days.

(21) Appl. No.: 16/090,703

(22) PCT Filed: Oct. 27, 2017

(86) PCT No.: PCT/FI2017/050743
§ 371 (c)(1),
(2) Date: Oct. 2, 2018

(87) PCT Pub. No.: WO2018/078221
PCT Pub. Date: May 3, 2018

(65) Prior Publication Data

US 2019/0118189 A1 Apr. 25, 2019

(30) Foreign Application Priority Data

Oct. 27, 2016 (FI) ..... 20165813

(51) Int. Cl.
*B02C 19/00* (2006.01)
*B02C 18/00* (2006.01)
*B02C 1/06* (2006.01)

(52) U.S. Cl.
CPC ..... *B02C 19/0006* (2013.01); *B02C 1/06* (2013.01); *B02C 18/00* (2013.01); *B02C 18/0076* (2013.01); *B02C 19/00* (2013.01)

(58) Field of Classification Search
CPC . B02C 19/0006; B02C 19/00; B02C 18/0076; B02C 18/00
(Continued)

(56) References Cited

U.S. PATENT DOCUMENTS 1,448,013 A 3/1923 Warren
1,704,823 A 3/1929 Denny
(Continued)

FOREIGN PATENT DOCUMENTS

CN 203803567 9/2014
DE 585915 3/1933
(Continued)

OTHER PUBLICATIONS

International Search Report for PCT/FI2017/050743, dated Feb. 21, 2018, 4 pages.
(Continued)

*Primary Examiner* — Faye Francis
(74) *Attorney, Agent, or Firm* — Nixon & Vanderhye P.C.

(57) ABSTRACT

An apparatus for comminuting of material that includes a first conveyor structure with a first conveyor surface, a second conveyor structure with a second conveyor surface, and in which apparatus the first conveyor surface and the second conveyor surface are set facing each other. The conveyor surfaces are configured in a double-converging manner so that in addition to said convergence in the movement direction, the conveyor surfaces are additionally placed in a convergent manner so that the gap between the conveyor surfaces also narrows in the transverse direction in relation to the movement direction, such that the comminuting space becomes double-converging.

18 Claims, 4 Drawing Sheets

(58) Field of Classification Search
USPC ..... 241/200
See application file for complete search history.

(56) References Cited

U.S. PATENT DOCUMENTS

| | | | | |
|---|---|---|---|---|
| 2,150,984 | A * | 3/1939 | Near | B23D 31/008 241/101.4 |
| 2,959,364 | A | 11/1960 | Anderson et al. | |
| 2,981,486 | A * | 4/1961 | Goto | B02C 9/00 241/200 |
| 3,691,942 | A * | 9/1972 | Wagley | B30B 9/325 100/151 |
| 4,285,373 | A | 8/1981 | Buchanan | |
| 4,566,641 | A * | 1/1986 | Okamoto | B02C 18/0076 144/163 |
| 5,636,800 | A * | 6/1997 | Wolf | B02C 19/0068 241/14 |
| 5,713,269 | A * | 2/1998 | Maurer | B30B 9/321 100/152 |

FOREIGN PATENT DOCUMENTS

| | | |
|---|---|---|
| EP | 1 073 523 | 3/2002 |
| EP | 3 020 864 | 5/2016 |
| GB | 709729 | 6/1954 |
| JP | 2006-231267 | 9/2006 |
| NL | 8303265 | 4/1985 |
| WO | WO 2011/142663 | 11/2011 |
| WO | 2014/001428 | 1/2014 |

OTHER PUBLICATIONS

Written Opinion of the ISA for PCT/FI2017/050743, dated Feb. 21, 2018, 5 pages.

Search Report for FI 20165813, dated Apr. 28, 2017, 1 page.

Office Action for FI 20165813, dated Apr. 28, 2017, 4 pages.

Search Report issued in EP Appln. No. 17865680.7 dated Jun. 15, 2020.

* cited by examiner

APPARATUS AND METHOD FOR COMMINUTING OF MATERIAL

This application is the U.S. national phase of International Application No. PCT/FI2017/050743 filed 27 Oct. 2017 which designated the U.S. and claims priority to FI Patent Application No. 20165813 filed 27 Oct. 2016, the entire contents of each of which are hereby incorporated by reference.

BACKGROUND OF THE INVENTION

There exists a great need for comminuting of material in the mining, mineral, and cement industries. The noteworthy issue is that comminuting material is the biggest energy-consuming process of these industrial sectors.

The energy consumption required by the comminuting process depends on the material type and its magnitude is typically 20-60 kWh/t, but in fine comminuting may be as much as 100-1000 kWh/t.

Friction and the heat it causes takes up most of the energy consumption in comminuting. The main part of the amount of energy required is used at the grinding stages, the costs of which in a mineral concentration process may be up to 70% of the concentration costs.

Some of the prior art apparatuses and methods are disclosed in publications U.S. Pat. Nos. 2,981,486, 1,704,823 and GB709729.

There are, however, problems associated with the prior art methods. The problem with the prior art methods and apparatuses is their high energy consumption and modest efficiency. A further problem is the low quality of the end product, that is, the fine particles, due to the breaking manner of the particles based on fast compression, which leads to arbitrary fracture planes in the area of principal stress fields, and the formation of a hyperfine fraction which is difficult to process.

SUMMARY OF THE INVENTION

An object of the invention is thus to develop an apparatus and a method so as to solve or alleviate the above problems.

The object of the invention is achieved by an apparatus and method which are characterized by what is stated in the independent claims. Preferred embodiments of the invention are disclosed in the dependent claims.

The invention is based on a new kind of mutual positioning of conveyor surfaces, which in turn allows free crushing, in other words, particle-specific slow compression of solid material and its weakening by increasing micro-cracks.

The advantage of the inventive apparatus and method is low energy consumption, a high-quality end product, as well as a well-defined and reliable device structure. The invention additionally makes it possible to divide the end products into material flows according to different particle sizes.

BRIEF DESCRIPTION OF THE FIGURES

The invention will now be described in more detail in connection with preferred embodiments and with reference to the accompanying drawings, in which.

DETAILED DESCRIPTION OF THE INVENTION

The invention relates to comminuting of material by compression, by way of example in particular to comminuting of elastoplastic material. Minerals, for example, serve as an example of a comminutable, at least partly elastoplastic material. If the material is homogeneous and fully elastic, the stress field formed in the material is distributed according to the location of the compression points and surface area in the material, and the stress field may be calculated relatively accurately based on the bond strength between atoms. In practise, all the comminutable material particles are non-homogeneous and at least slightly plastic, and they typically include a plurality of matter components unevenly distributed in the material and which have discontinuity points and micro-cracks at their boundary surfaces, in particular. In addition to minerals, ceramic material and glass are elastoplastic material.

The apparatus GD shown in the figures comprises a first conveyor structure C1 having a first conveyor surface B1. The apparatus also comprises a second conveyor structure C2 having a second conveyor surface B2. Both conveyor surfaces B1, B2 are conveyor surfaces rotatable in the direction of movement D, in a way like a chain track, which rotates according to its closed-loop shape full rotations supported by its support structure SS and powered by one or more motor M1A, M2A or another actuator M1A, M2A. The actuator M1A, M2A rotating the conveyor surface B1, B2 is an electric motor or a hydraulic motor or another actuator, for example. The actuator M1A, M2A forms means for bringing the conveyor surfaces B1, B2 in a movement in the direction of movement D where the two conveyor surfaces B1, B2 placed to face each other are arranged to move from a first end E1 of the conveyor structures C1, C2 towards a second end E2 of the conveyor structures. It is obvious that at the second end E2 of the apparatus, the movement direction of the conveyor surfaces becomes the opposite as the rotation movement of the conveyor surfaces B1, B2 turns the movement into the return direction, but the movement in the return direction takes place at the outer sides of the pair of conveyor structures C1, C2 and is at the rear end, so the second end E2, towards the front end, so the first end.

However, what is essential in the apparatus is the structures defining the comminuting space GS, so the edges of the area where the conveyor surfaces B1, B2 face each other. As mentioned, the conveyor surfaces B1, B2 define the comminuting space GS.

Figure 3:
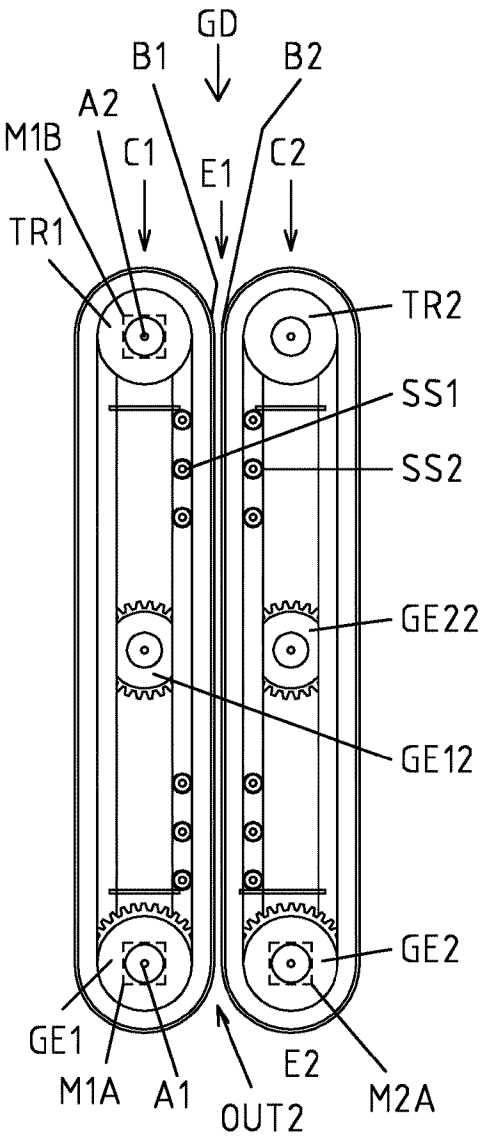
FIGS. 1-3 are top views of the apparatus from different height levels, examined in the transverse direction in relation to the direction of movement of the conveyor surfaces, and illustrating the changing of the wedge angle at different heights, the point of examining proceeding in the transverse direction in relation to the direction of movement of the conveyor surfaces.
Figure 2:
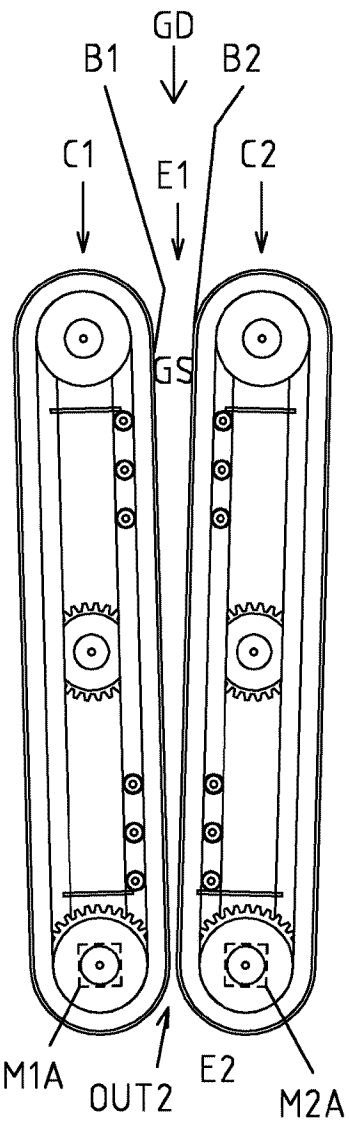
Figure 1:
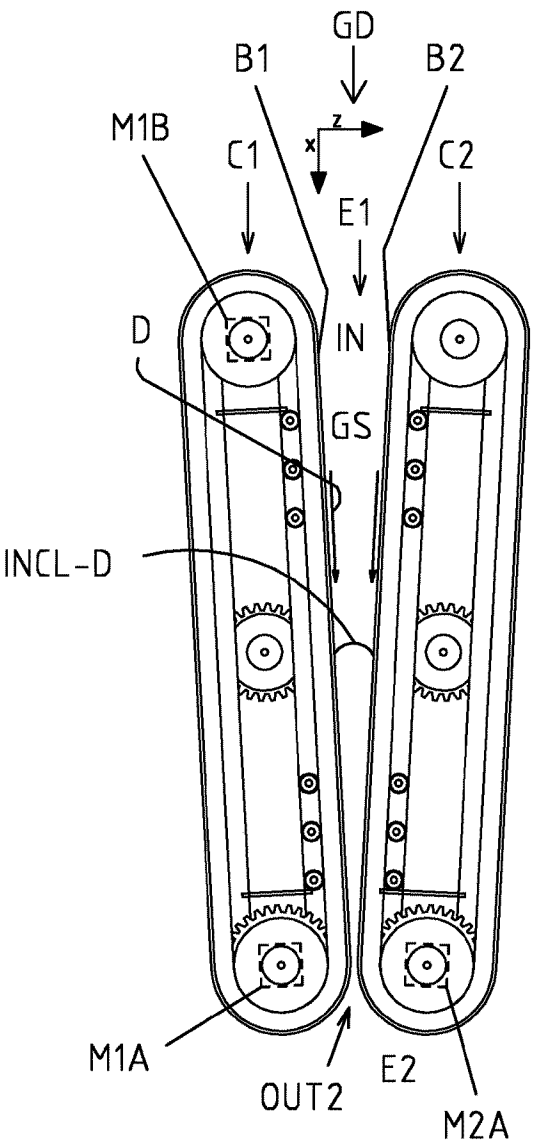

At least at one end of the conveyor surfaces B1, B2, the conveyor structures C1, C2 have under the conveyor surface, a drive wheel, drive gear of a similar drive transmitter GE1, GE2 that transfers the rotational force provided by the actuator MIA, M2A to the conveyor surface B1, B2. In addition, the conveyor structures have at the opposite end idler wheels TR1, TR2 on which the conveyor surfaces B1, B2 pass and turn into the return movement. FIGS. 1-3 show the drive wheels GE12, GE22 also in the area between the ends, such as in the centre area of the conveyor structure.

The apparatus structure is such that the means M1A, M2A for bringing the conveyor surfaces B1, B2 into a movement in the direction movement D are arranged to bring the conveyor surfaces B1, B2 into a rotational movement according to successive full rotations.

In addition, the conveyor structure such as C1, C2 comprises a support structures SS1, SS2 to support the rotational movement of its conveyor surface B1, B2, the support structure may be accomplished with supporting rolls, and naturally it is plausible to see the aforementioned idler wheels TR1, TR2 as included in the support structures and likewise the drive wheels GE1, GE12, GE2, GE22.

The conveyor surface such as B1 and correspondingly B2 is, as mentioned in the above, a closed loops that rotates successive full rotations supported by drive wheels GE1, GE12 and correspondingly GE2, GE21, as well as idler wheels TR1 and correspondingly TR2, and also the support rolls SS1 correspondingly SS2.

Referring to FIGS. 1-3 and 6, the axle A1 of the drive wheel GE1 is fitted with a bearing BR1 to a support member SM1 such as a slide rail SM1 by means of which an actuator HM1 such as a hydraulic actuator moves the lower end of the axle A1 in relation to the fixed frame FR of the apparatus (frame FR shown partially).

Correspondingly, the axle A2 of the idler wheel TR1 is fitted with a bearing BR2 to a support member SM2 such as a slide rail SM2 by means of which an actuator HM2 such as a hydraulic actuator moves the lower end of the axle A2 in relation to the fixed frame FR of the apparatus.

FIGS. 1-3 and 6 do not show the frame of conveyor because it would cover the top part of the conveyor, among other things, so the structures that the figures show of the conveyors C1, C2.

Between the ends of the conveyor such as C1 there may be other vertical axles between axles A1, A2, and their ends may have device structures as the ones disclosed. There may be another number of drive wheels than the two drive wheel pairs in the example of the figures.

In the apparatus, the first conveyor surface B1 and the second conveyor surface B2 are positioned facing each other. This way, the conveyor surfaces B1, B2 are arranged to define the comminuting space GS where the material is comminuted by the compression provided by the moving conveyor surfaces B1, B2.

From the point of view of the material to be comminuted, the apparatus comprises an inlet IN, and from the point of view of material already comminuted, the apparatus comprises outputs OUT1 and OUT2. Output OUT 1 is at the substantially horizontal lower edge of the apparatus and in practise it is a gap left between the lower edges of the conveyor surface pair B1, B2, which extends at the lower edge of the conveyor towards the rear end E2. Output OUT2 is at the rear end E2 of the apparatus, where the movement direction D is aimed, in practise output OUT2 is the end point of the area facing each other in the conveyor surfaces B1, B2 at the second end E2, so the rear end, of the conveyor structures C1, C2.

To subject the material to compression, the structure is such that in the apparatus the conveyor surfaces B1, B2 positioned to face each other are placed in a convergent manner so that the gap between the conveyor surfaces B1, B2 narrows when examined in the movement direction D of the conveyor surfaces, so that the advancing movement of the conveyor surfaces B1, B2 is arranged to bring about compression in the material being comminuted.

The convergence angle of the convergence in the movement direction of the conveyor surfaces, that is, the wedge angle, is marked with INCL-D in FIGS. 1-3 and 4.

The convergence angle, transverse in relation to the movement direction of the conveyor surfaces, is marked with nip angle INCL-TD. The angle INCL-TD is in FIG. 5 upward-opening (so downward converging) angle between the conveyor surfaces B1, B2.

Figure 4:
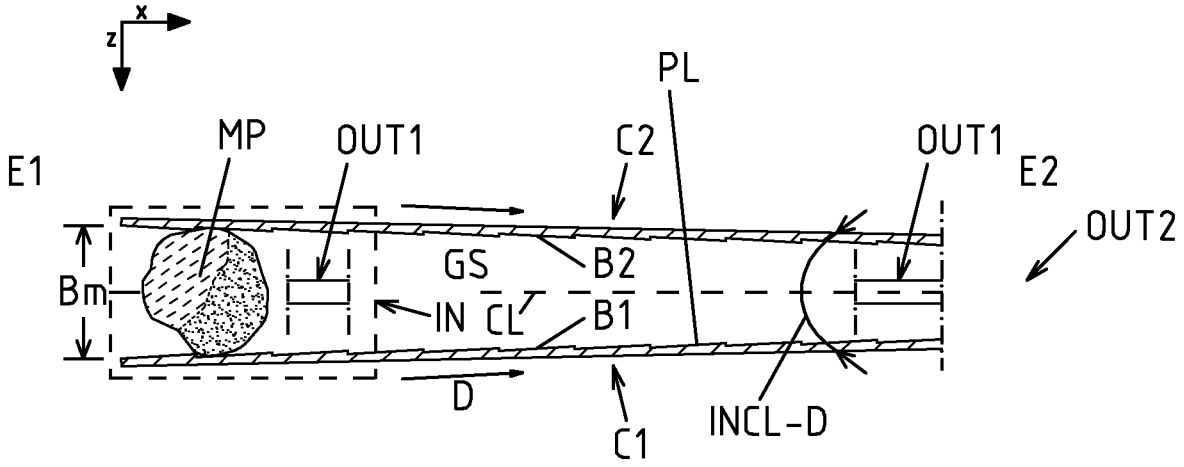
FIG. 4 illustrates, from the top, the principle of the position of the conveyor surfaces of the comminuting apparatus at the inlet, examined in the transverse direction in relation to the direction of movement and illustrating the wedge angle, that is, convergence of the conveyor surfaces in the direction of movement.
Figure 5:
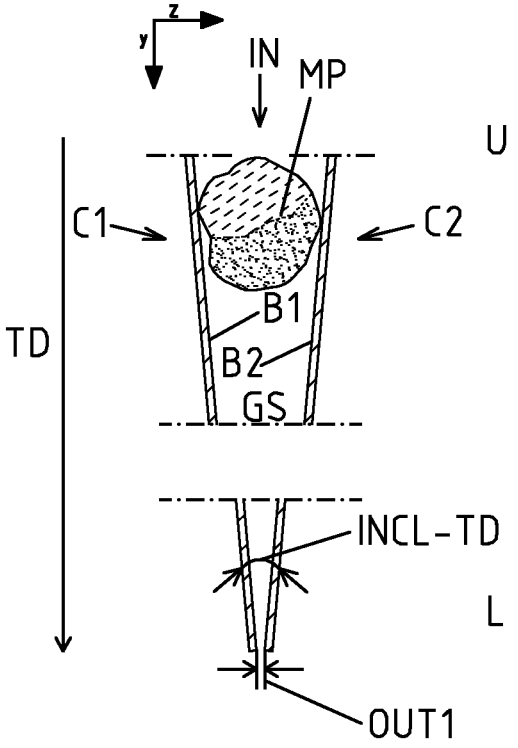
FIG. 5 illustrates the principle of the position of the conveyor surfaces of the comminuting apparatus from the first end, that is, the front end, examined in the direction of movement and illustrating the nip angle, that is, the convergence of the conveyor surfaces detected in the transverse direction in relation to the direction of movement.
Figure 7:
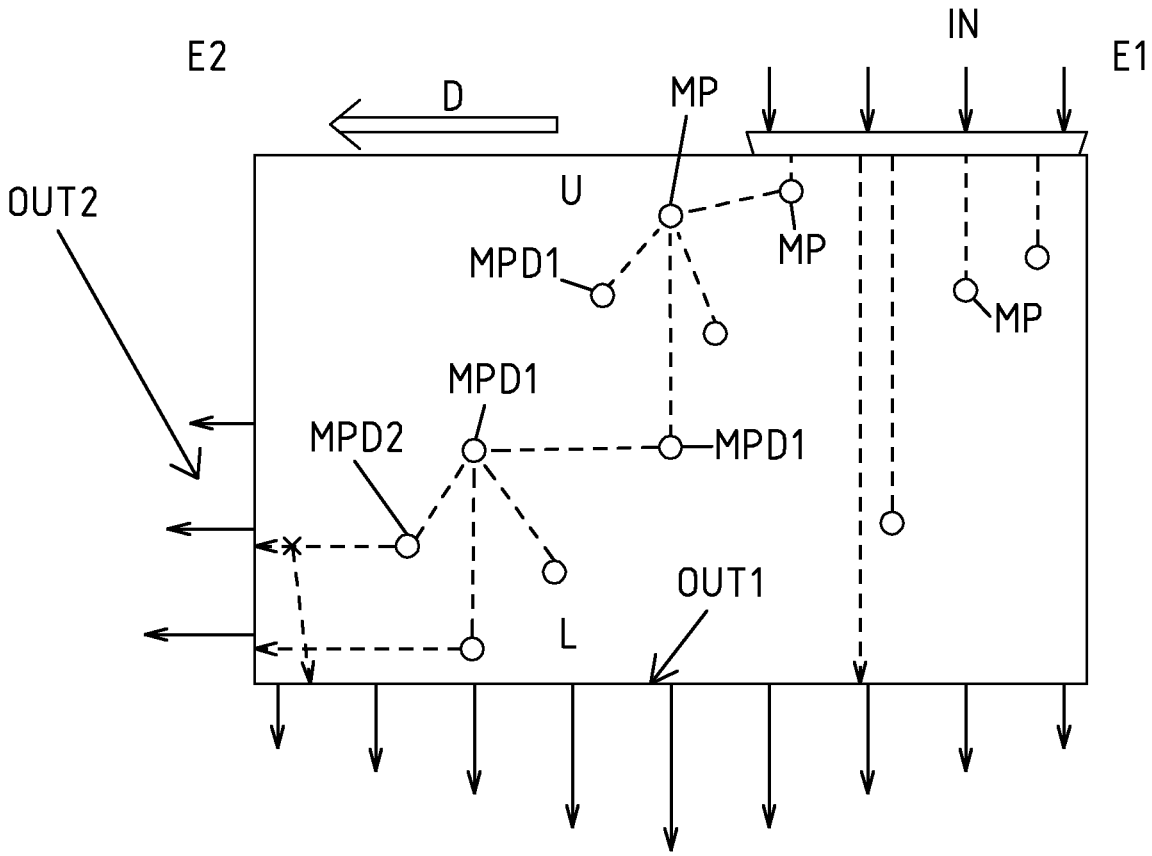
FIG. 7 is a schematic diagram of the apparatus from the side and compression in that context, material particles, daughter particles, and subparticles of daughter particles.

Referring to FIGS. 5 and 7 and the comparison in FIGS. 1-3, the core of the invention is that in the apparatus the conveyor surfaces B1, B2 are in a double-converging manner so that in addition to said convergence in the movement direction (direction D), so narrowing, the conveyor surfaces B1, B2 are additionally placed in a convergent manner so that the gap between the conveyor surfaces B1, B2 also narrows in the transverse direction TD in relation to the movement direction D. This way, the comminuting space GS becomes double-convergent. In its clearest form, this convergence in the transverse direction TD, so nip angle INCL-TD, in relation to the movement direction D, is seen in FIG. 4 where the movement direction is away from the viewer.

In the comminuting space GS the transverse convergence, so the nip angle INCL-TD (FIG. 5), decreases towards the rear end E2 so that the width of the lower part of the comminuting space GS remains the same of decreases according to the nip angle INCL-D set (which changes in the vertical direction, so decreases downward), and so that the nip angle INCL-TD (FIG. 5) is zero at the open rear end E2 of the comminuting space GS, which means that the distance between the walls of the comminuting space GS, that is, the conveyor surfaces B1, B2 at the open end E2 at the output OUT2 is the same as the width of the output OUT1 of the lower part at its narrowest. In the method according to the invention, material is sorted, transported and cracked into sufficiently fine-grained material everywhere in the comminuting space GS, in particular in successive areas/places of the comminuting space GS in the movement direction as mentioned, and comminuted material is removed from all parts of the comminuting space Due to the joint effect of these functions, the compression and cracking of particles is mostly realized in a layer one particle thick and particle-specifically, and always with a force that always matches with the breaking strength of the particle regardless of its tensile properties. The comminuting of particles is performed at temporally successive stages so that after comminuting a particle MP, the comminuting of its daughter particle MPD1, that is, a daughter piece MPD1 is carried out at a spot that is both at a lower position between the conveyor surfaces B1, B2 and at the same time further in the movement direction D, correspondingly the comminuting of the subparticle MPD2 of the daughter particle MPD1 is performed at a spot that is also at a still lower position between the conveyor surfaces B1, B2 and at the same time further still in the movement direction D. This way, a longer dwell time, that is, processing time in compression, is achieved for the smaller particles, so the daughter particles and subparticles MPD2 comminuted from them.

Although the top view FIGS. 1-3 and also in FIG. 4, the convergence angle INCL-D, so nip angle, of the convergence in the movement direction may be detected as regard the angle, by comparing FIGS. 1-3 another issue may be noticed, that is, an issue related to the nip angle INCL-TD (FIG. 5), that is, a convergence angle of convergence transverse in relation to the movement direction of the conveyor surfaces. This is because in FIGS. 1-3 the conveyor surfaces B1, B2 are in the different figures (different height positions) at different distances from each other, and when it is taken into account that FIGS. 1-3 are conceptual views from a different height, that is, in FIG. 1 the height position of examining is the top part of the conveyor surfaces, in FIG. 2 the height position of examining is the centre part of the conveyor surfaces.

With reference to FIGS. 1-3 and 4, according to the applicant's observations a suitable degree for convergence, that is, wedge angle INCL-D at the level of the top part of the conveyor surfaces B1, B2 (as in FIG. 1), in particular, is approximately 5-10 degrees, by way of example 8 degrees shown in FIG. 1. But since these are two opposite conveyor surfaces B1, B2, so placed facing each other, inclined into different directions, the inclination position of both conveyor surfaces B1, B2, so at the top part of the conveyor surface pair, in such a case one half of the aforementioned degrees, that is, 2.5-5 degrees, in relation to the centre line CL passing between the conveyor surfaces. The top part U and lower part L of the conveyor surfaces are best seen in FIGS. 5 and 7.

The comminuting ration, that is, crushing ration refers to the ratio between the size of the inlet IN and output OUT1 of the apparatus, and it is between 5-15. for example. The size of the inlet should be taken as a function of varying height as in FIGS. 1-3 depending on the height position of the point of examining (conveyor top part FIG. 1, centre part FIG. 2, lower edge FIG. 3). FIGS. 1-3 additionally show that the wedge angle varies from the 8 degrees at the top part (FIG. 1) inlet—feed edge to the 0 (zero) degrees at the lower edge (FIG. 3) of the conveyor FIGS. 1-3 are horizontal plane, cross-cut, principled views from three planes: FIG. 1 top edge where the wedge angle is 8 and the crushing ratio hence approximately 14, FIG. 2 centre level between the top and lower edge where the wedge angle INCL-D is 4 and the crushing ratio approximately 7.5 and in addition FIG. 3 from the lower edge of the conveyor pair, so at the level of the lower output that is output OUT 1 of the material where the wedge angle INCL-D is approximately 0.5. To be precise, the conveyor surfaces B1, B2 travel along a slightly curved line on the side of the comminuting space GS, the mutual distance between the conveyor surfaces B1, B2 approaching a distance that corresponds to the set value of the output at the lower part L and rear end E2 of the comminuting apparatus/crusher. The output OUT1 at the lower edge may either be straight (as seen in the movement direction D) or slightly wedge-like, that is, for example 0.5 degree in FIG. 3 so that a particle that has stopped just above the lower edge is compressed before exiting the end E2, but is not necessarily broken. Such a weakening may be important in a further process (for example, dissolving) where product particles should have as many micro-cracks as possible.

The magnitude of the wedge angle INCL-D (FIG. 4), that is, the convergence between the conveyor surfaces B1, B2 in the conveying direction, so the movement direction, depends of the height level being examined (FIGS. 1-3 from different height levels) and on how the magnitude of the nip angle INCL-TD (FIG. 5) changes in this direction. In an embodiment, the wedge angle (INCL-D) is the largest at the top parts of the comminuting space GS (FIG. 1) and its value decreases towards the lower height levels and is at its lowest at the level of the lower edge (FIG. 3), where it may be set to zero or otherwise very low. This is why in the comminuting space GS the smallest particles MPD1, MPD2 stopped at the lower levels travel a longer distance during compression and compression is thus slower than with the larger particles MP.

With reference to FIGS. 5 and 7, in particular, in an embodiment the apparatus is such that the conveyor surfaces B1, B2 which are placed facing each other which may be brought into movement are arranged to comminute one or more material particles MP comprised by the material for forming one or more smaller daughter particles MPD1 from the material particle MP. It is further the case that the conveyor surfaces B1, B2 that create the convergence in the transverse direction TD in relation to the movement direction are arranged lower in the comminuting space GS to stop the falling movement of such a daughter particle MPD1 formed in the comminuting space GS, to focus a movement in the movement direction on conveyor surfaces B1, B2 also to the daughter particle MPD1. This way, the daughter particle proceeds in the movement direction D1 and because the comminuting space is converging, so narrowing, in the movement direction as in FIGS. 4 and 1, for example, the daughter particle MPD1 will, at some point of proceeding, be met with such a tight compression that it breaks and from the daughter particle a smaller subparticle MPD2 is created, which as FIG. 7 shows falls downward until it stops (as the daughter particle MPD1 but at a lower position and having proceeded further in the movement direction D) between the conveyor surfaces B1, B2 reaching a movement in the movement direction, and the subparticle exits the vertical end gap at the rear end E2 of the device.

Depending on the length of the conveyor surfaces, the device settings (speed of motion of the conveyor surfaces, nip angle, wedge angle) and the particle size of the incoming material, there may also be more height positions for the compression point (three in the above) and particle size categories (three in the above, so incoming particle MP, daughter particle MPD1, and subparticle MD2 of daughter particle).

If the size of the subparticle MPD2 is already smaller than the exit gap OUT1 at the lower edge, the "finished" subparticle MPD2 can exit through output OUT1.

It may obviously also be the case that the incoming particle MP or daughter particle MPD1 is already small enough to exit through the output OUT1 at the lower edge.

Consequently in the invention, the grading/distribution, conveying and cracking is repeated everywhere in the comminuting space GS particle-specifically in a layer no more than one particle thick.

It is detected that the direction TD, transverse in relation to the movement direction D, in which direction said transverse convergence exists between the conveyor surfaces, is a substantially perpendicular transverse direction in relation to the movement direction D of the conveyor surfaces. It is furthermore the case that the existing conveyor structures are so positioned that the movement direction D of the conveyor surfaces is substantially horizontal.

Further, the conveyor structures facing each other are so placed that the direction TD transverse in relation to the movement direction D of the conveyor surfaces is substantially vertical.

This being the case, referring in particular to FIGS. 1-3, 4-5 and 7, the comminuting is performed in the vertical direction (such as TD) and also in the horizontal direction (such D) in the converging, wedge-like comminuting space GS, the walls of which, so the conveyor surfaces B1, B2, move in the horizontal movement direction D towards the gap-like end, that is, the output OUT1, and the wedge angle of which, so the convergence of the comminuting space GS in the movement direction decreases in the movement direction of the walls, so the conveyor surfaces B1, B2, and from the top part of the front end E1 of which the feed particles, that is, the particles MP in their original size, are dropped into the mouth formed by the walls, that is, the conveyor surfaces B1, B2 at the inlet IN.

The feed particles smaller than the gap-like lower part, so the output OUT1, in the comminuting space GS, fall freely in the vertical direction or, if need be, assisted by a gas or fluid flow, and exit the comminuting space at its gap-like output OUT1 at its lower edge.

Alternatively, feed particles larger than the gap-like lower part, so the output OUT1, are graded by stopping (because of the convergence according to the nip angle INCL-TD in the transverse direction in relation to the movement direction D, that is, vertical direction) at the height levels according to their sizes, that is, between the conveyor surfaces B1, B2. The walls, so the conveyor surfaces B1, B2, of the comminuting space GS then carry the particles in the movement direction D towards the rear end E2 and at the same time compress the particles that have got wedged between the walls, that is, the conveyor surfaces B1, B2, which may exit directly from the gap-like output OUT2 of the comminuting space GS, or before that crack according to their breaking strength and whereby the created daughter particles (or the latter subparticles MPD2 of the daughter particle) fall in the comminuting space vertically lower either through the output OUT1 at the lower edge, or if the transverse (in relation to movement direction) convergence of the comminuting space GS, so in practise the conveyor surfaces, stops the daughter particle MPD1 still too large, the conveyor surfaces B1, B2 transport the daughter particle in the movement direction towards the output OUT2 in which case the daughter particle MPD1 either breaks during the movement and creates the subparticle MPD2 or exits from the output OUT2 at the rear end E2 of the device. Correspondingly, the subparticle MPD2 either drops into the output OUT1 or due to the nip angle stops before the output OUT1 and joins the movement of the conveyor surfaces into the direction D towards the output OUT2 at the rear end.

This way, a long dwell time is achieved for the daughter particles MPD1 and their subparticles MPD2, that is, a slow compression which improves the compression and the comminuting quality. In the invention, particles are compressed slowly and widely enough so that the maximum number of micro-cracks weakening the material would develop into the material. Slow compression is an energy-efficient way to comminute material. In slow compression, the probability of a compression member to create additional, unwanted kinetic energy and friction to the daughter pieces is the smallest. Furthermore, slow compression results in more evenly sized daughter pieces that is daughter particles/subparticles and less non-selective small daughter pieces/subpieces in the areas of the principal stress fields than a fast, impact-like loading.

Slow compression is implemented successively, also for the daughter pieces created in the cracking, and repeated (that is, the stopping of the falling of the daughter piece due to the nip angle and the continuation of the movement in the movement direction made possible by the stopping) until the size of the resulting particles is small enough, so smaller than the output OUT1 at the lower part of the device. Elastic energy stored between the compressions in the compressions is released and the particles must have the chance to change their position before the subsequent compression stage leading to cracking. The repetition of such compression-release stages enhances the creation and growth of micro-cracks in the particle parts remaining intact. The compression-release cycles are implemented so that the material gradually weakens in all the size categories undergoing compression, also in the size categories preceding the product size (so, the size going to the output OUT1).

Referring to FIGS. 5 and 7 and the comparison in FIGS. 1-3, the core of the invention is that in the apparatus the conveyor surfaces B1, B2 are in a double-converging manner so that in addition to said convergence in the movement direction (direction D), so narrowing, the conveyor surfaces B1, B2 are additionally placed in a convergent manner so that the gap between the conveyor surfaces B1, B2 also narrows in the transverse direction TD in relation to the movement direction D. This way, the comminuting space GS becomes double-convergent. In its clearest form, this convergence in the transverse direction TD, so nip angle, in relation to the movement direction D, is seen in FIG. 4 where the movement direction is away from the viewer.

According to the observations of the applicant, a suitable nip angle (INCL-TD (FIG. 5) is, for example, 5-20 degrees. This depends of the particle size and size distribution of the material, for example.

The size of the material particles MP coming in to the inlet IN is between 0.10-200 mm, for example.

The comminuted particle size obtained from the output OUT1 is between 0.1-5 mm, for example. A suitable speed of motion for the conveyor surfaces B1, B2 in the movement direction D, as created by the motors MIA, M2A, is 0.02-0.5 m/s, for example. In connection with the motors, or controlling the motors, there may be a control unit by means of which the speed of the conveyor surfaces B1, B2 may be adjusted, in particular so that the speed of motion of the conveyor surfaces B1, B2 slightly differs from each other. So, the speed of motion of the conveyor surfaces B1, B2 maybe adjusted to slightly differ from each other. The purpose of the speed difference is to increase the effective ares of compression and to cause shear forces and twisting forces in the particle, increasing the micro-cracks. To avoid wear and tear as well as friction, the speed difference must be small, at most 5%, for example.

With the inventive calculated rubbing, the load is directly aimed at the particles. By deliberately making use of the speed difference between the conveyor surfaces B1, B2 to create rubbing, small particle sizes are accomplished with a significantly lower volumetric energy consumption.

The following is remarked about the conveyor surfaces B1, B2. Referring to FIGS. 4-5 and 7, for example, the conveyor surfaces B1, B2 comprised by the conveyor structures C1, C2, compression lamellas PL may be slightly turned (either due to their material or fastening) or on the compression lamellas PL, or otherwise, there may be fastened an elastic, continuous band which may be smooth or patterned (symmetrically or asymmetrically, for example) in various ways. The purpose of the elastic layer of the conveyor surfaces B1, B2 is to increase the surface area the particle is subjected to when compressed. The purpose of the shaping of the conveyor surfaces B1, B2 is to prevent the material pieces from sliding backwards and to boost the cutting force components of the compression. In an embodiment, the thickness and elasticity of the elastic layer is larger in the top part of the conveyor surfaces B1, B2 (than in the lower part), in which top part the transitions leading to cracking are larger due to the bigger size of the particles, compared to the lamellas at the lower part where the wedge load is lighter.

Figure 6:
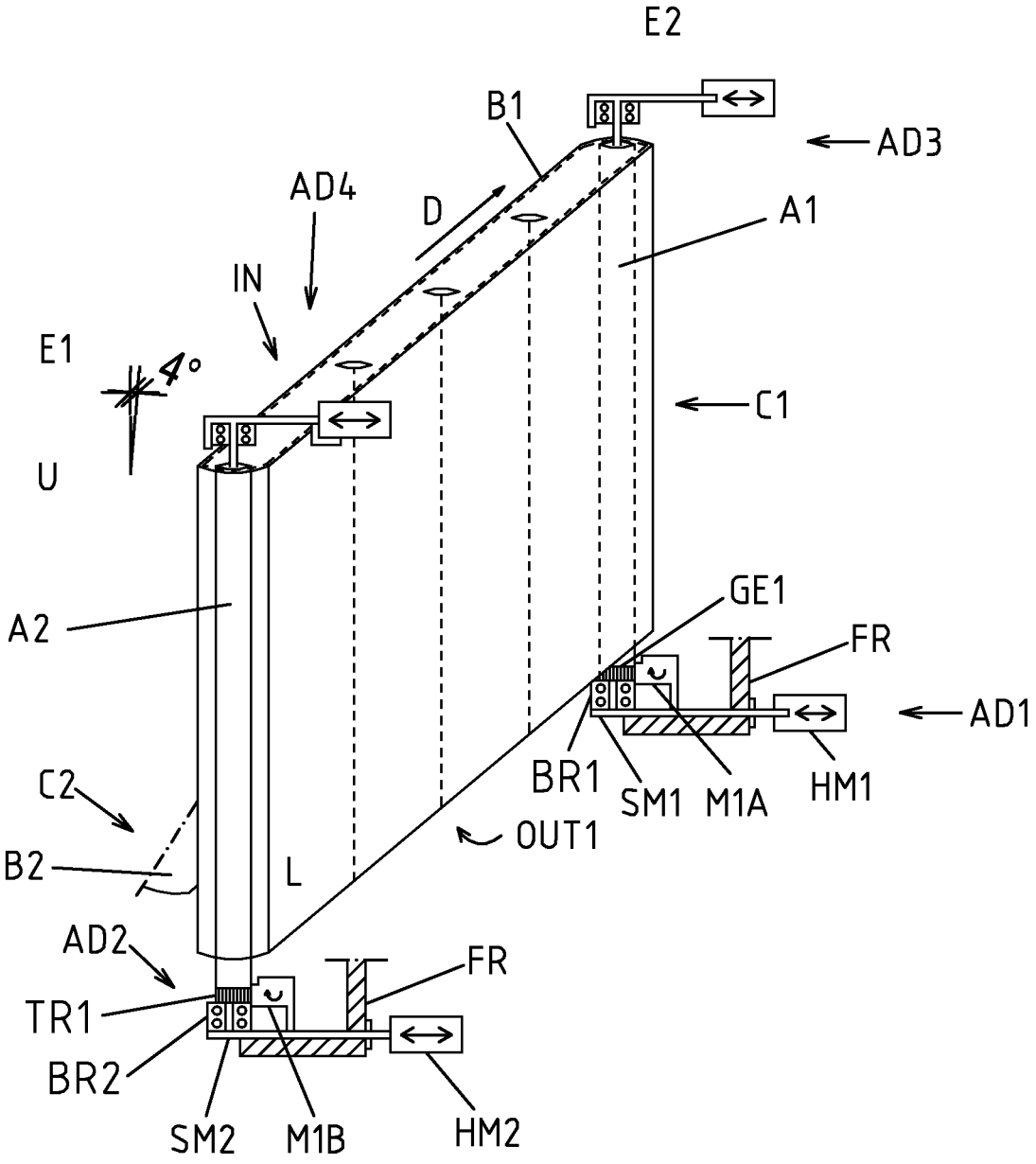
FIG. 6 is a schematic view of the conveyor structure, illustrating the adjustment structures.

To be discussed next are adjustment structures AD1-AD4 shown in FIG. 6, for adjusting the position/location of the conveyor structures C1, C2 or their conveyor surfaces B1, B2 FIG. 6 is a schematic view of the conveyor structure, illustrating the adjustment structures. The adjustment may be performed on the conveyor structure C1, C2 or directly on the actual conveyor surface B1, B2.

It is a good idea to be able to adjust one or more of the following: adjustment of the convergence angle INCL-D of the convergence in the movement direction, so the wedge angle, adjustment of the convergence angle INCL-TD of the convergence in the direction TD transverse in relation to the movement direction D, so the nip angle, adjustment of the distance between the conveyor surfaces B1, B2 and/or adjustment of the speed of motion of the conveyor surfaces.

The device structures for performing the various adjustments may be partly or entirely the same device structures AD1-AD4. The apparatus thus comprises adjustment means AD1-AD4 for the conveyor surfaces B1, B2 for adjusting the convergence angle INCL-D of the convergence in the movement direction, so the wedge angle, and the same or different adjustment means for adjusting the convergence angle INCL-TD of the convergence in the direction TD transverse in relation to the movement direction D, so the nip angle, and the same or different adjustment means for adjusting the speed of motion and distance between the conveyor surfaces B1, B2.

FIG. 6 shows the adjustment means AD1-AD4 of one conveyor structure C1, the structures may be similar in the second conveyor structure C2, also (FIG. 6 only show a bottom corner), the location of which would in FIG. 6 be on the left side of the conveyor structure C1 or in parallel with it.

In FIG. 6, the adjustment means AD1-AD4 may be mutually similar, so the structure of the adjustment means is discussed as relates to the adjustment means AD1, in particular.

In FIG. 6, the conveyor structure C1 is shown as seen from the inlet side IN at the front end E1. FIG. 6 shows end axles A1 and A2 of the conveyor structure, and at the lower end of the axle A1, a rotating motor M1A and at the lower end A2 a rotating motor M1B, if required.

The adjustment means AD1 comprise an actuator HM1, such as a hydraulic motor/hydraulic piston HM1, and a support member SM1 such as a slide rail SM1 by means of which the actuator HM1 moves in the spot in question a subentity that includes the end axle A1 with its bearing housing, the drive gear GE1, rotating motor M1A of the end axle.

Each of the conveyor structures C1, C2 may be separately adjusted with the adjustment means AD1-AD4 within the limits set for the device. By moving the conveyor structure, the distance between the conveyor surfaces B1, B2 as well as the nip angle INCL-TD and wedge angle INCL-D are adjusted, so the relative transition created by the conveyors and the sizes of the inlet IN or output OUT1, OUT2 may be adjusted. The conveying speed of each conveyor surface B1, B2 consisting of lamellas and/or a belt is adjusted according to the material properties and capacity with the speeds of the motors MIA, M2A.

The adjustment of the wedge angle INCL-D, so the convergence in the movement direction, is performed for the conveyor C1 by adjusting, with the adjustment structures AD2 (actuator HM2, in particular), AD4 at the front edge E1 of the conveyor, the conveyor C1 to move by its front edge E1 more to the right horizontally, so away from the second conveyor structure (C2, only lower corner seen in FIG. 6).

The adjustment of the nip angle INCL-TD, so the convergence in the transverse direction in relation to the movement direction, is carried out by adjusting the top edge of the conveyor structure C1 by the adjustment structures AD3, AD4 therein to tilt more to the right, that is, away from the second conveyor structure (C2, only lower corner seen in FIG. 6).

The adjustment of the distance between the conveyor surfaces B1, B2, when it is not desired to change the nip angle INCL-TD or the wedge angle INCL-D, but when it is desired to change the size of the comminuting space GS, takes place by performing a horizontal move right or left with all the adjustment means AD1-AD4.

Referring to FIG. 7, for example, the method is next examined in closer detail. This concerns a method for comminuting elastoplastic material, for example. In the method, material containing material particles MP is conveyed by the movement of conveyor surfaces B1, B2 in opposing conveyor structures C1, C2 of the comminuting apparatus in the movement direction D in the comminuting space GS between the conveyor surfaces. By conveying the material particles MP further and further in the movement direction D, the material particles are comminuted when examined in the movement direction D in a converging comminuting space between conveyor surfaces so that one or more daughter particles MPD1 are formed from the material particle MP by comminuting with the aid of the compression created by the moving conveyor surfaces B1, B2.

The core of the method is that the method uses said conveyor surfaces B1, B2 defining the comminuting space D, in which method the comminuting space GS is also convergent when examined in the transverse direction in relation to the movement direction, the converging conveyor surfaces B1, B2 stopping between the conveyor surfaces the falling movement of such a daughter particle MPD1 formed in the comminuting space GS, after which with these still moving conveyor surfaces, a movement into the movement direction is also achieved for one or more daughter particles MPD1.

It is naturally the case that the comminuting space GS converging transversely (in relation to movement direction) in accordance with the nip angle INCL-TD, so in practise the conveyor surfaces B1, B2 defining it in a convergent manner stop the incoming material particle, so one that falls through the inlet IN, and so it will be subjected to the movement in the movement direction of the conveyor surfaces, so movement in the direction D.

It is the case that the daughter particle MPD1 is conveyed by the movement of conveyor surfaces in the opposing conveyor structures of the comminuting apparatus in the movement direction D in the comminuting space between the conveyor surfaces B1, B2. By conveying the daughter particle MPD1 further and further in the movement direction D, the daughter particle is comminuted, when examined in the movement direction D, in a converging (angle INCL-D FIG. 4) comminuting space between conveyor surfaces so that one or more subparticles of the daughter particles are formed from the daughter particle by comminuting with the aid of the compression created by the moving conveyor surfaces. This continues so that the conveyor surfaces B1, B2 converging (angle INCL-TD, FIG. 4) the comminuting space in the transverse direction in relation to the movement direction, stop between the conveyor surfaces the falling movement of such a subparticle MPD2, so the subparticle MPD2 of the daughter particle formed between in the comminuting space GS, after which with these still moving conveyor surfaces B1, B2, a movement into the movement direction is also achieved for one or more subparticles MPD2 of the daughter particle.

Daughter particles MPD1 and/or subparticles MPD2 of daughter particles and/or still smaller material particles comminuted from subparticles are removed from the comminuting space through the output at the lower edge of the comminuting space. OUT1. This takes place when the particle size during comminuting becomes smaller than the output OUT1 at the lower edge.

In parallel or alternatively daughter particles MPD1 and/or subparticles MPD2 of daughter particles and/or still smaller material particles comminuted from subparticles are removed from the comminuting space through the output at the rear end, so output OUT2, of the comminuting space, where the movement direction D is directed. This takes place when the particle size during comminuting remains larger than the output OUT1 at the lower edge of the apparatus.

It is practical when the movement direction D of the conveyor surfaces B1, B2 is substantially horizontal, and the conveyor surfaces stop a particle MP, or daughter particles MPD1 and/or subparticle MPD2 of a daughter particle and/or even smaller material particles comminuted from a subparticle in a substantially vertical falling movement.

The slow compression characteristic of the method is individually targeted directly to the particle in all the size categories and implemented in an open space so that the compressed particles and the created daughter particles (and their sub-pieces) have as little contact with each other as possible and may immediately exit their breaking spot by the effect of gravity or the release of the force caused by the elastic energy stored therein in compression. So, particles small enough have the chance to exit the comminuting space GS altogether through the output OUT1 at the lower edge, which reduces the probability of product-sized (=the desired particle size) comminuting. When dealing with fine particle sizes, the exit of daughter pieces may be primarily boosted by a gas flow or, if further processing so dictates, with a fluid flow, such as water. When hot gas is used, the material being comminuted may be dried, or when a chemically appropriate inert gas is used (in other words, the proportion of nitrogen or carbon dioxide in the gas), it is possible to control the chemical state of the surfaces parts of the material particles. With a liquid flow, the redox state of the particles may be controlled, if it is justified to perform further processing with a flotation process.

As a summary, it may be set forth that: The compression of particles takes place freely, without side support by other particles or support points, whereby the growth of micro-cracks during compression is facilitated and the break occurs more easily. Compression takes mostly place in a layer of one particle, whereby the compression force of the conveyor surfaces B1, B2 is always focused directly on the particle and with a lower energy consumption that if a group of particles were compressed. Compression takes place slowly, whereby the energy used for breaking per a new surface area is the smallest. The compression of particles in the comminuting space GS is performed at different times as the particle size decreases and as successive events when the conveyor surfaces B1, B2 stop all the particles too big for a product according to their sizes at the height level according to the nip angle INCL-TD for further compression. Particles and daughter particles formed from them coming in with the incoming particle feed, the size of which is already small enough, do not after exiting affect the conveying or compression events of the conveyor surfaces B1, B2, so there will be no added friction or lower compression effect. In the comminuting space GS, only particles larger than the product size (which comes through the output OUT1) are conveyed and comminuted/crushed, whereby as little energy as possible is used for the conveying of the particles and the capacity of the comminuting space GS is used efficiently. With a gas or liquid flow opposite to the conveying direction, the exit of the product particles may be enhanced and the chemical state of new particles may be changed without interfering with the cracking events taking place in the comminuting space.

A person skilled in the art will find it obvious that, as technology advances, the basic idea of the invention may be implemented in many different ways. The invention and its embodiments are thus not restricted to the above-described examples but may vary within the scope of the claims.

The invention claimed is:

1. An apparatus for comminuting of material, the apparatus comprising a first conveyor structure with a first conveyor surface, a second conveyor structure with a second conveyor surface, and in which apparatus the first conveyor surface and the second conveyor surface are set facing each other and the conveyor surfaces thus being arranged to define a comminuting space in the apparatus, and which apparatus is configured to bring the conveyor surfaces into a movement in a movement direction where the conveyor surfaces facing each other are arranged to move from a first end of the conveyor structures towards a second end of the conveyor structures, and in which apparatus the conveyor surfaces set facing each other are set in a converging manner so that a gap between the conveyor surfaces narrows in the movement direction of the conveyor surfaces so that the advancing movement of the conveyor surfaces is arranged to bring about compression on the material comminuted in a convergence in the movement direction, wherein in the apparatus the conveyor surfaces are in a double-converging manner so that in addition to said convergence in the movement direction, the conveyor surfaces are additionally placed in a further converging manner so that the gap between the conveyor surfaces also narrows in a transverse direction in relation to the movement direction, said comminuting space thus becoming double-converging, and wherein the first and second conveyor structures facing each other are configured such that the transverse direction in relation to the movement direction of the conveyor surfaces is substantially vertical.

2. An apparatus as claimed in claim 1, wherein the conveyor surfaces are configured to move and to comminute one or more material particles comprised by the material in order to form one of more smaller particles from the material particle, and in that the conveyor surfaces that create the convergence in the transverse direction in relation to the movement direction are arranged lower in the comminuting space to stop the falling movement of such a smaller particle formed in the comminuting space, to focus a movement in the movement direction on conveyor surfaces also to the smaller particle.

3. An apparatus as claimed in claim 1, wherein the direction, transverse in relation to the movement direction, in which direction said transverse convergence exists between the conveyor surfaces, is a substantially perpendicular transverse direction in relation to the movement direction of the conveyor surfaces.

4. An apparatus as claimed in claim 1, wherein the first and second conveyor structures facing each other are configured such that the movement direction of the conveyor surfaces is substantially horizontal.

5. An apparatus as claimed in claim 1, wherein the apparatus is configured to adjust a convergence angle of the convergence in the transverse direction in relation to the movement direction.

6. An apparatus as claimed in claim 1, wherein the apparatus is configured to adjust the distance between the conveyor surfaces.

7. An apparatus as claimed in claim 1, wherein the apparatus is configured to adjust a convergence angle of the convergence in the movement direction.

8. An apparatus as claimed in claim 1, wherein the apparatus is configured to bring the conveyor surfaces into a rotational movement according to successive full rotations.

9. An apparatus as claimed in claim 8, wherein both conveyor structures comprise a support structure to support the rotational movement of their conveyor surfaces.

10. A method for comminuting of material comprising:

moving material including material particles via the movement of conveyor surfaces of opposing conveyor structures of a comminuting apparatus into a movement direction in a comminuting space between the conveyor surfaces, and by conveying the material particles further and further in the movement direction, comminuting the material particles in the movement direction in a converging comminuting space between the conveyor surfaces so that one or more smaller particles are formed from the material particle by comminuting with a compression created by the moving conveyor surfaces, wherein said conveyor surfaces defining said comminuting space, in which method the comminuting space is also convergent in the transverse direction in relation to the movement direction, the converging conveyor surfaces stopping, between the conveyor surfaces, a falling movement of such a smaller particle formed in the comminuting space, after which with the moving conveyor surfaces, one or more smaller particles move into the movement direction, and wherein the conveyor structures facing each other are configured such that the transverse direction in relation to the movement direction of the conveyor surfaces is substantially vertical.

11. A method as claimed in claim 10, wherein moving the smaller particle via the movement of conveyor surfaces of opposing conveyor structures of the comminuting apparatus into a movement direction in a comminuting space between the conveyor surfaces, and by conveying the smaller particle further and further in the movement direction the smaller particle is comminuted in the movement direction in a converging comminuting space between conveyor surfaces so that one or more subparticle of the smaller particle are formed from the smaller particle by comminuting with the aid of the compression created by the moving conveyor surfaces.

12. A method as claimed in claim 11, wherein in the direction transverse in relation to the movement direction, the conveyor surfaces defining the converging comminuting space stop, between the conveyor surfaces, the falling movement of such a subparticle of a smaller particle formed in the comminuting space, after which with these still moving conveyor surfaces, a movement into the movement direction is also achieved for one or more subparticles of the smaller particle.

13. A method as claimed in claim 10, wherein smaller particles and/or subparticles of smaller particles and/or still smaller material particles comminuted from subparticles are removed from the comminuting space through the output at the lower edge of the comminuting space.

14. A method as claimed in claim 10, wherein smaller particles and/or subparticles of smaller particles and/or still smaller material particles comminuted from subparticles are removed from the comminuting space at the rear end of the comminuting space where the movement direction is directed.

15. A method as claimed in claim 13, wherein particles fed into the comminuting space and smaller particles and/or subparticles of smaller particles created in the comminuting space are removed from the outputs at the lower edge and rear end of the apparatus from a plurality of successive spots of the comminuting space so that when the particles fed into the comminuting space and the smaller particles and/or their subparticles created in the comminuting space are smaller than the output at the lower edge and/or rear end, they exit the comminuting space between the conveyor surfaces by a falling movement.

16. A method as claimed in claim 10, wherein the movement direction of the conveyor surfaces is substantially horizontal, and in that the conveyor surfaces stop a smaller particles and/or a subparticle of a smaller particle and/or even smaller material particles comminuted from a subparticle, in a substantially vertical falling movement.

17. A method as claimed in claim 10, further comprising adjusting a speed of motion of the conveyor surfaces.

18. A method as claimed in claim 17, wherein the speed of motion of the conveyor surfaces is adjusted so that the speeds of motion of the conveyor surfaces differ from each other.

* * * * *